US007458414B2

(12) United States Patent
Simon

(10) Patent No.: US 7,458,414 B2
(45) Date of Patent: Dec. 2, 2008

(54) HYDRAULIC RESERVOIR WITH INTEGRATED HEAT EXCHANGER

(75) Inventor: Matthew H. Simon, Kalamazoo, MI (US)

(73) Assignee: Parker-Hannifin Corporation, Cleveland, OH (US)

( * ) Notice: Subject to any disclaimer, the term of this patent is extended or adjusted under 35 U.S.C. 154(b) by 656 days.

(21) Appl. No.: 11/113,947

(22) Filed: Apr. 25, 2005

(65) Prior Publication Data

US 2006/0016184 A1 Jan. 26, 2006

Related U.S. Application Data

(60) Provisional application No. 60/590,262, filed on Jul. 22, 2004.

(51) Int. Cl.
*F28D 7/02* (2006.01)

(52) U.S. Cl. ..... 165/41; 165/47; 165/119; 165/132; 165/169; 165/916; 210/167.06; 210/175; 210/186; 210/167.32; 210/167.07; 184/104.1; 60/456; 60/912; 123/196 AB

(58) Field of Classification Search ..... 165/47, 165/916, 132, 41, 119, 169; 210/167.06, 210/167.32, 175, 186, 167.07; 184/104.1; 60/456, 912; 123/196 AB
See application file for complete search history.

(56) References Cited

U.S. PATENT DOCUMENTS 1,849,042 A * 3/1932 Rogers et al. ..... 210/186
1,856,771 A * 5/1932 Loeffler ..... 165/119
1,901,484 A * 3/1933 Winslow et al. ..... 210/186
2,450,960 A * 10/1948 Heintz ..... 165/132
2,460,888 A * 2/1949 Koinzan ..... 210/186
3,688,940 A 9/1972 Knight et al.
3,887,467 A * 6/1975 Johnson ..... 210/186
4,074,752 A * 2/1978 Schlosberg ..... 184/104.1
4,368,775 A 1/1983 Ward
4,669,533 A * 6/1987 Hehl ..... 165/47
4,813,477 A * 3/1989 Hansen et al. ..... 165/119
4,878,536 A * 11/1989 Stenlund ..... 165/916
5,144,801 A 9/1992 Scanderbeg et al.

(Continued)

OTHER PUBLICATIONS

"Cumulo Hydrostatic Drive—a Vehicle Drive with Secondary Control", authored by Conny Hugosson, presented at The Third Scandinavian International Conference on Fluid Power on May 25-26, 1993, in Sweden.

*Primary Examiner*—John K Ford
(74) *Attorney, Agent, or Firm*—Christopher H. Hunter

(57) ABSTRACT

Improvement, in hydraulic systems, such as for vehicle transmissions and the like, in the form of a hydraulic reservoir with integrated heat exchanger having fluid supply/return and fluid return ports, including a central section, having inner and outer shell portions with a first gap therebetween, the outer shell being provided with a plurality of radially-spaced, external cooling fins, longitudinally-directed for the length of the central section; the ends of the latter being closed off via respective bottom and top cap portions, thereby defining a central fluid cavity, the top cap portion having spaced outer and inner cap portions, with a second gap therebetween, with a fluid inlet port, in the outer cap portion, directing incoming fluid from the second gap into and through the entire length of the first gap before entering the central fluid cavity, thereby maximizing heat transfer from the fluid via the plurality of cooling fins.

22 Claims, 2 Drawing Sheets

U.S. PATENT DOCUMENTS 5,513,490 A 5/1996 Howell et al.
5,718,281 A 2/1998 Bartalone et al.
5,927,071 A * 7/1999 Asanuma et al. ..... 60/396
6,035,930 A * 3/2000 Schwartz ..... 165/47
6,502,630 B1 * 1/2003 MacFarlane et al. .. 123/196 AB
6,736,605 B2 5/2004 Ohashi et al.

* cited by examiner

HYDRAULIC RESERVOIR WITH INTEGRATED HEAT EXCHANGER

CROSS-REFERENCE TO RELATED CASES

The present application claims the benefit of the filing date of U.S. Provisional Application Ser. No. 60/590,262, filed Jul. 22, 2004, the disclosure of which is incorporated herein by reference.

FIELD OF THE INVENTION

The present invention pertains to a hydraulic reservoir with integral heat exchanger (HRwiHE), for use, for example, in hydraulic transmissions for trucks and the like, with the HRwiHE being part of the hydraulic cooling circuit. More particularly, the HRwiHE utilizes a plurality of external cooling fins, associated with a central section of the HRwiHE to maximize the heat transfer from the working fluid.

BACKGROUND OF THE INVENTION

Hydraulic or hydrostatic transmissions, for example, for on-highway vehicles such as trucks, have received greater interest in recent years as the price of fuel has increased sharply. Hydrostatic transmissions (HSTs) have an advantage over conventional hydrodynamic and gear transmissions in regard to fuel efficiency due to their ability to recover kinetic energy during braking via hydraulic accumulators, and also due to the fact that the prime mover or engine is uncoupled from the drive wheels, thus allowing the engine to always operate at its most efficient operating range, regardless of vehicle speed and torque demands.

In order for HSTs to successfully compete with conventional transmissions, their increased fuel efficiency must not be offset by other factors, such as decreased reliability, lower performance, increased cost, weight and complexity, etc. One of the shortcomings of HSTs is their relatively lower transmission efficiency. Although vehicles having HSTs with brake energy recovery can exhibit reduced fuel usage of up to fifty percent, depending on driving conditions, the transmission itself is less efficient. Therefore, supplementary heat exchangers for cooling the transmission fluid are generally employed. These devices increase cost, weight, and number of fluid connections and thus leak points, and make the system more difficult to package on the vehicle.

HSTs with brake energy recovery employ hydraulic accumulator(s) to store energy from braking. During a braking event, the vehicle's drive wheels provide the energy for the HST to pump high pressure fluid into the accumulator, which acts to slow the vehicle. In order to maximize the amount or energy that can be recovered, relatively large accumulators must be used, with the size thereof being largely dependent upon the size of the vehicle. This pressurized fluid is later discharged through the transmission to drive the wheels, with the fluid, used to fill the accumulator, being supplied by a low pressure reservoir. When the accumulator is subsequently discharged to propel the vehicle, the fluid is transferred back to the low pressure reservoir. Therefore, the volume of the low pressure reservoir must approximately equal the volume of the high pressure accumulator.

A major reason for the relative inefficiency of HSTs is that the fluid is always passed through two hydraulic pump/motors. For instance, during a braking event, the HST pumps high pressure fluid into the accumulator, which adds heat to the fluid when the accumulator is discharged through the HST. The same thing occurs when power is supplied by the engine, since the engine-driven pump adds its inefficiency to the fluid in terms of heat, with the pump/motor further adding its own inefficiency. Although each pump/motor, by itself, typically has good efficiency (85-95%), the overall efficiency can be as low as 85%×85%=72% during worst case conditions. Even if the average efficiency throughout all driving conditions is 90% per pump/motor, the overall transmission efficiency is only 81%. For a vehicle that operates at high power levels for a large portion of its duty cycle, such as a refuse truck, this heat load can be on the order of 50 horsepower. Without means to cool the transmission fluid, the system would overheat very quickly. A typical means used to cool the transmission fluid is illustrated in prior art FIG. 1. Further details, in terms of such transmission technology, are set forth in a paper entitled "Cumulo Hydrostatic Drive—a Vehicle Drive with Secondary Control", which was presented by its author, Conny Hugosson, at The Third Scandinavian International Conference on Fluid Power, on May 25-26, 1993, in Linköping, Sweden.

The patent literature includes a large number of patents pertaining to heat transfer apparatuses that include but are not limited to: U.S. Pat. No. 3,688,940 to Knight et al.; U.S. Pat. No. 4,368,775 to Ward; U.S. Pat. No. 5,144,801 to Scanderbeg et al.; U.S. Pat. No. 5,513,490 to Howell et al.; U.S. Pat. No. 5,718,281 to Bartalone et al.; U.S. Pat. No. 6,261,448 B1 to Merchant et al.; and U.S. Pat. No. 6,736,605 B2 to Ohashi et al. However, none of these prior art structures set forth or suggest a hydraulic reservoir consisting of spaced inner and outer shells with a suitable intermediate gap wherein the outer shell is provided with external fins to effect efficient heat transfer, with the working fluid being drawn fro the reservoir and the being returned to the reservoir through the integrated heat exchanger.

SUMMARY OF THE INVENTION

The present invention takes advantage of relatively large low pressure hydraulic reservoirs, and the thus large surface areas, to provide cooling in lieu of separate heat exchangers via the combination of the previously separate heat exchanger and low-pressure reservoir into a unitary component, thereby reducing system cost, weight and size, while increasing reliability.

The resulting system basically comprises a pressure vessel with spaced inner and outer shells forming an annular area (in cross-section) that is sized in accordance with projected flow rate requirements. The outer shell is provided with cooling fins to maximize the surface area exposed to air, thereby increasing heat rejection and the dissipation thereof. The outer shell additionally contains the several fluid ports required for hydraulic connections.

Specifically, in terms of structure, a first embodiment of the invention provides a hydraulic reservoir with integrated heat exchanger comprising: a. a generally cylindrical central section having an inner cylindrical shell portion and a peripherally-spaced cylindrical outer shell portion, with a first annular gap therebetween, the outer shell portion being provided with a plurality of external cooling fins; b. a bottom cap portion, closing the central section at a lower end portion thereof; c. a top cap portion, closing the central section at an upper end portion thereof, having an outer cap portion and a spaced inner cap portion, with a second gap therebetween forming a direct continuation of the central section first gap, the outer cap portion including a fluid inlet port in communication with the second gap; d. the, central section, together with the top and bottom cap portions, defining an internal central fluid cavity containing pressurized fluid; and e. a fluid supply/ return port and at least one fluid outlet port extending into the central fluid cavity; wherein incoming fluid, into the fluid inlet port, flows from the second gap into and through the entire length of the first gap before entering the central fluid cavity, thereby maximizing heat transfer from the fluid via the plurality of external cooling fins.

In one variation thereof, the plurality of external cooling fins is peripherally spaced and substantially radially arranged, with each of the plurality of external cooling fins preferably extending longitudinally for substantially the entire axial extent of the central section.

In another variation, the external cooling fins are integral with the cylindrical outer shell portion and the cylindrical outer shell portion is fabricated via one of extrusion and die casting.

In a further variation, the cylindrical outer shell portion is constructed of a light metal, which is preferably an aluminum alloy.

In a differing variation, the at least one fluid outlet port is located in the bottom cap portion.

In yet another variation, the fluid supply/return port is located in the lower end portion of the central section and is preferably so situated that the fluid flow is substantially tangentially directed relative to the central fluid cavity.

In yet a further variation, the top and bottom cap portions are one of a hemi and semi-hemispherical shape.

In yet a differing variation, the hydraulic reservoir with integrated heat exchanger is mounted in a substantially vertical position, the substantially vertical configuration minimizing the possibility of fluid movement within the central fluid cavity, thereby minimizing the potential of cavitation of associated hydraulic pump/motor(s), with the substantially vertical configuration also maximizing heat exchange effectiveness due to the long vertical distance the fluid travels while in contact with the cylindrical outer shell portion.

In still another variation, cylindrical inner and outer shell portions are connected via a plurality of intermediate spacers that also serve to maintain the uniformity of the first gap therebetween.

In still a further variation, the fluid inlet port also includes a fluid flow straightener that serves to peripherally, uniformly, channel incoming fluid flow into the second gap and further includes a central cone portion and a plurality of spaced, radial, riblets.

A still a differing variation further includes a peripheral, generally cylindrical shroud that surrounds the central section and the bottom cap portion, the shroud serving as a ram air device for the hydraulic reservoir with integrated heat exchanger, when air is in motion and preferably additionally includes a forced air flow device, located at an end of the shroud, remote from the bottom end cap portion, the flow device providing forced convection, relative to the hydraulic reservoir with integrated heat exchanger and causing same to function as a single pass counterflow integrated heat exchanger.

In a second embodiment of the present invention, in a hydraulic cooling circuit, a hydraulic reservoir with integrated heat exchanger, the latter comprising in combination: a. a substantially cylindrical central section having an inner cylindrical shell portion and a peripherally-spaced outer cylindrical shell portion, with a first gap therebetween, the outer shell being provided with a plurality of radially-spaced, external cooling fins, the cooling fins being directed substantially along the entire length of the central section; b. a curved bottom cap portion, closing the central section at a lower end portion thereof; c. a curved top cap portion, closing the central section at an upper end portion thereof, having an outer cap portion and a spaced inner cap portion, with a second gap therebetween forming a direct continuation of the central section first gap; d. the central section, together with the top and bottom cap portions, defining an internal central fluid cavity; and e. a fluid inlet port in the top cap portion, with a fluid supply/return port and at least one fluid outlet port extending into the central cavity; wherein incoming fluid, into the fluid inlet port, flows from the second gap into and through the first gap before entering the central fluid cavity, thereby maximizing heat transfer, from the fluid therein, via the plurality of external cooling fins.

One variation thereof further includes a peripheral, generally cylindrical, shroud that surrounds the central section and the bottom cap portion, the shroud serving as a ram air device for air in motion relative thereto. This variation preferably also includes a forced air flow device, located at an end of the shroud remote from the bottom cap portion, the flow device providing forced air convection relative to the hydraulic reservoir with integrated heat exchanger and causing same to function as a single pass counterflow with integrated heat exchanger.

In another variation, the reservoir with integrated heat exchanger is mounted in a substantially vertical position, the substantially vertical configuration minimizing the possibility of fluid movement within the central cavity, thereby minimizing cavitation in associated hydraulic components.

The previously-described advantages and features, as well as other advantages and features, will become readily apparent from the detailed description of the preferred embodiments that follow.

BRIEF DESCRIPTION OF THE DRAWINGS

Prior art

DETAILED DESCRIPTION OF THE INVENTION

Figure 1:
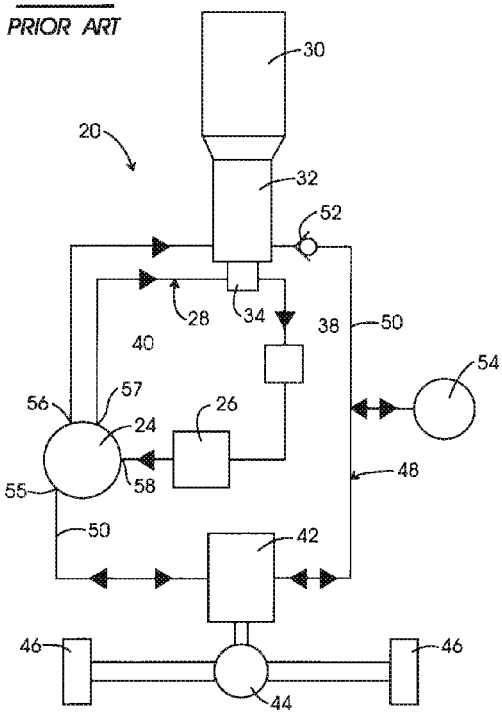
FIG. 1 PRIOR ART
FIG. 1 is a simplified system diagram of a known hydrostatic transmission for a motor vehicle that utilizes, in its transmission fluid cooling circuit, both a low pressure hydraulic reservoir and a separate heat exchanger.

Referring now to the several drawings, illustrated in prior art FIG. 1 is a simplified system diagram, generally indicated at 20, of a known hydrostatic type of a hydraulic transmission for, as an example, a motor vehicle such as a highway truck, that utilizes both a low pressure hydraulic reservoir 24 and a separate liquid-to-air heat exchanger 26 in its transmission cooling circuit 28. Those skilled in the art will readily recognize that a prime mover 30, such as an internal combustion engine, drives a main hydraulic pump 32 which, in turn may also drive a separate cooling pump 34, if so desired. Interposed between cooling pump 34 and low pressure hydraulic reservoir 24 are heat exchanger 26 and, upstream thereof, a fluid filter 38. Items or components 24, 26, 34 and 38 are fluidically operatively interconnected via a line, conduit or bores 40 and together, comprise fluid cooling circuit 28.

System diagram 20 further illustrates the use of a pump/motor(s) 42 whose output drives an axle 44 and subsequently wheels 46 in a well known manner. Main pump 32 is fluidically operatively interconnected with pump/motor 42 via a driving/driven circuit 48 via another line 50 that, on one side thereof, also includes a check valve 52, at main pump 32, and a high pressure fluid accumulator 54, between check valve 52 and pump/motor(s) 42. Another side of line 50, between pump/motor(s) 42 and main hydraulic pump 32 includes a tie-in with low pressure reservoir 24.

The function and operation of the above-noted components of system diagram 20 are well known and, in the interest of brevity, will not be discussed in detail herein. Diagram 20 is set forth only to show the basic structural components of a hydrostatic transmission and sets forth but one example of a hydraulic mechanism in which the hydraulic reservoir with integrated heat exchanger (hereinafter HRwiHE) or vessel 62 (FIG. 2) of this invention finds utility. As a point of interest, cooling pump 34 is normally of a relatively small displacement with regard to those of engine-driven main pump and pump/motor(s) 42. Cooling pump 34 also operates at a relatively low pressure, as it must provide only enough energy to force its fluid flow through filter 38, heat exchanger 26 and hydraulic reservoir 24. It should be understood that there are many possible configurations, in addition to those illustrated in FIG. 1, for the mounting and driving of cooling pump 34. As will be explained in more detail hereinafter, low pressure hydraulic reservoir 20 is provided with a plurality of ports, with ports 55 and 56 being associated with driving circuit 48, while ports 57 and 58 are associated with fluid cooling circuit 28.

Figure 2:
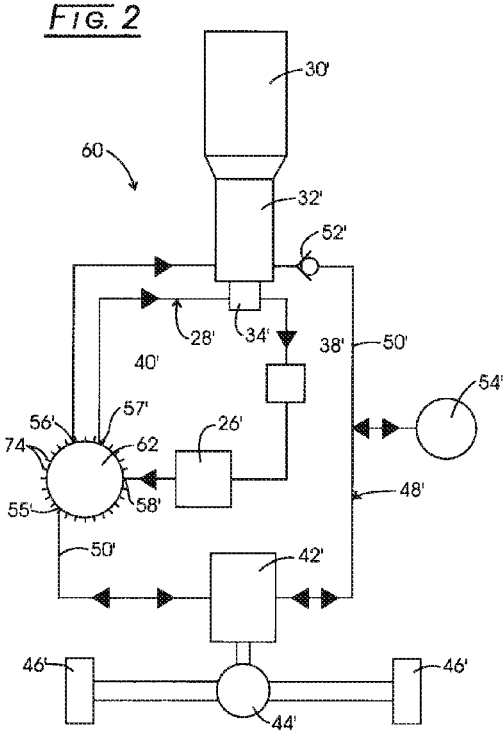
FIG. 2 is a simplified system diagram, similar to that of FIG. 1, wherein the noted separate hydraulic reservoir and heat exchanger have been replaced by the unitary hydraulic reservoir with integrated heat exchanger of the present invention.

Turning now to FIG. 2, illustrated therein is a simplified system diagram 60 similar to that of FIG. 1, with like components being denominated with like numerals followed by a prime (') suffix. Specifically, in FIG. 2, the separate heat exchanger 26 (FIG. 1) and the low pressure hydraulic reservoir 24 (FIG. 1), in transmission fluid cooling circuit 28 (FIG. 1) have been replaced, in fluid cooling circuit 28', by the HRwiHE or vessel 62 of the present invention. It should be understood that cooling pump 34' is but a small power device with respect to main pump 32'.

Figure 3:
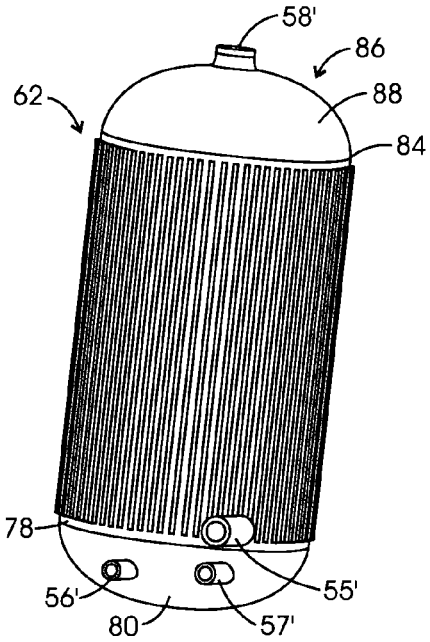
FIG. 3 is a perspective view of the reservoir with integrated heat exchanger of the present invention.
Figure 4:
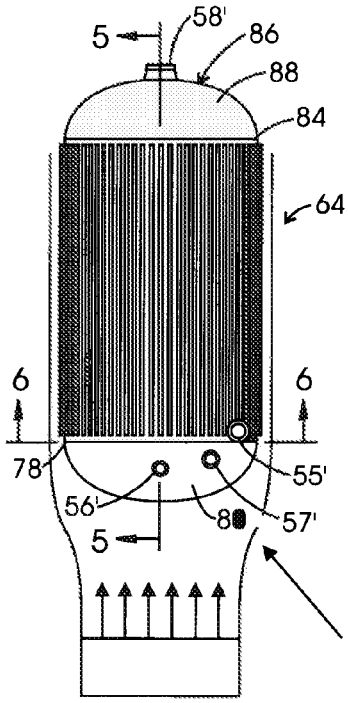
FIG. 4 is a frontal view of the reservoir with integrated heat exchanger of FIG. 3, including a forced air flow device and an optional external shroud.
Figure 5:
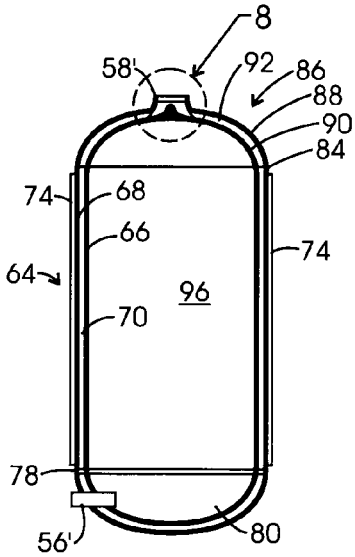
FIG. 5 is a vertical cross section, taken along line 5-5 of FIG. 4.
Figure 6:
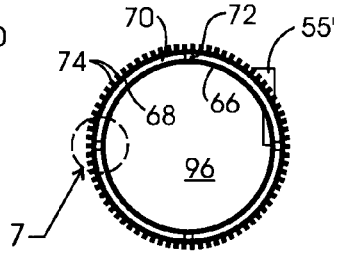
FIG. 6 is a horizontal cross section, taken along line 6-6 of FIG. 4.
Figure 7:
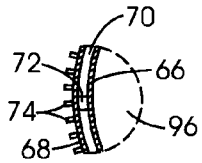
FIG. 7 is an enlarged detail of circled area 7 of FIG. 6.

Continuing now with FIGS. 3-8, illustrated therein are details of HRwiHE 62, which is basically a pressure vessel comprised of a central cylindrical section 64 having an inner cylindrical shell portion 66 and a preferably parallel, equally-spaced outer cylindrical shell portion 68, thus defining an annular cylindrical volume gap 70 therebetween, as best seen in FIGS. 5-7. Cylindrical shells 66, 68 are joined via a plurality of intermediate spacers 72 (FIGS. 6,7) that not only serve to maintain the uniform width of gap 70 but also affix inner shell portion 66 to outer shell portion 68, particularly at the vertical lower end thereof. Gap 70 (cross-sectional area) is sized for optimal pressure drop based on the amount of cooling flow required for the system, which is highly dependent upon the vehicle and its average power consumption. Outer cylindrical shell portion 68 includes a plurality of preferably radially arranged, equally spaced, external cooling fins 74 that function to maximize the exposed peripheral surface area of outer shell 68 to ambient air, thereby increasing the heat rejection and subsequent dissipation thereof. It should be understood that cooling fins 74, instead of extending vertically, could also be radially continuous and axially spaced along the longitudinal extent of outer cylindrical shell portion 68. Fins 74 are so spaced and sized to maximize cooling while taking ease of manufacturing into account. Suggested methods of fabricating outer shell 68, with integral fins 74, include extrusion and die casting. Two piece constructions could include slip-fitting and interference-fitting such as press-fitting but are less efficient than the noted integral constructions due to decreased heat transfer efficiency at the interface of the two piece constructions.

Cylindrical section 64 is closed or capped, at its vertical lower end portion 78, via a hemi or semi-hemispherical bottom cap portion 80 whose maximum outside diameter is substantially similar to that of outer shell portion 68, with bottom cap portion 80 thus essentially forming a curved continuation of outer shell portion 68. Cylindrical section 64 is additionally capped or closed, at its vertical upper end portion 84, via a hemi or semi-hemispherical top cap portion 86 having an outer cap portion 88 and a spaced inner cap portion 90, whose maximum outside diameters are substantially similar to those of outer and inner shell portions 68, 66, respectively, with cap portions 88 and 90 thus essentially forming curved continuations of shell portions 68, 66, respectively. An annular gap 92, between cap portions 88 and 90 forms a direct, curved continuation of gap 70 formed between inner and outer shell portions 66 and 68.

Figure 8:
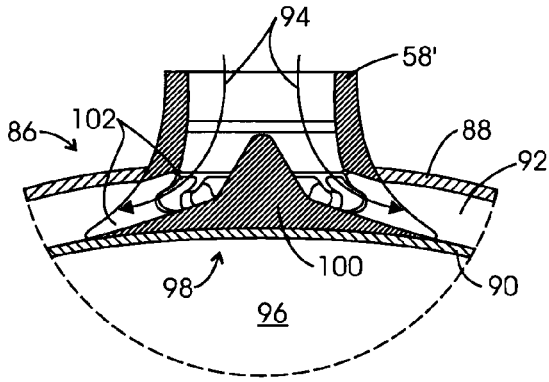
FIG. 8 is an enlarged detail of circled area 8 of FIG. 5.

Central cylindrical section 64, together with respective bottom and top cap portions 80 and 86, defines the internal cavity 96 of HRwiHE 62. As best seen in FIGS. 5 and 8, top cap portion 86 includes port 58' which serves as the inlet, into top cap portion annular gap 92, for the return flow of fluid from cooling circuit 28', as depicted by arrows 94 in FIG. 8. Preferably, the return flow of fluid impinges on an optional fluid flow straightener 98 that, for example, includes a central cone portion 100 and a plurality of preferably equally-spaced, radial, peripheral, riblets 102 that serve to peripherally channel the incoming fluid flow into annular gap 92. Flow straightener 98 functions to reduce fluid turbulence and improve the distribution of fluid flow through the annulus of port 58'. It should be understood, particularly when viewing FIG. 5, that incoming fluid, into top cap portion annular gap 92, must pass from gap 92 into central section annular gap 70 for the entire length or vertical extent of outer cylindrical shell portion 68, before it exits gap 70, at the vertical lower end portion 78 of central cylindrical section 64, before it enters HRwiHE central cavity 96, thereby maximizing heat transfer via cooling fins 74 associated with outer cylindrical shell portion 68.

As best seen in FIGS. 3-5, bottom cap portion 80 is provided with outlet port 56' which forms part of driving/driven circuit 48', while another outlet port 57' forms part of fluid cooling circuit 28'. Ports 56', 57' can actually be situated at any location as long as they extend into HRwiHE central cavity 96 and are sufficiently above the bottom thereof so as to avoid ingestion of contaminant particles that settle in bottom cap portion 80. Experience has shown that locating pump/motor supply/return port 55', which conducts fluid flow to/from pump/motor(s) 42, due to its often relatively high fluid velocity, is preferably located such that fluid flow is tangentially directed into central cavity 96, which results in the least amount of fluid aeration. Thus, for example, port 55' is located near the vertical lower end portion 78 of central section 64.

HRwiHE 62 is designed to be normally mounted in a vertical position on a vehicle, which minimizes the possibility that fluid movement, caused by vehicle movement, will uncover inlet ports 55' and 58', thereby preventing cavitation and subsequent damage of the hydraulic pumps. The noted vertical configuration mounting has the advantage of maximizing heat exchanger effectiveness due to the long vertical distance that the fluid travels while in contact with outer cylindrical shell portion 68. While other than vertical mounting configurations can be utilized, such mountings will make these pumps more susceptible to cavitation damage. HRwiHE 62 is preferably formed as a cylindrical vessel with hemispherical ends, with this form providing the necessary strength to weight ratio for resisting internal pressure while lending itself to simple manufacturing methods. Other shapes can also be utilized, for example, a cylindrical shape with circular, flat ends. Vessel 62 is preferably constructed of metal, e.g., a light metal such as an aluminum alloy material, to take advantage of the material's high coefficient of thermal conductivity and low density.

Concentrating now specifically on FIG. 4, there is illustrated the use of a forced air flow device 106, such as an axial flow fan, to transfer heat from vessel 62 via forced convection. Fan 106 is optionally enveloped with a shroud 108 which also envelopes HRwiHE bottom cap portion 80 and the axial extent of central cylindrical section 64 thereof. This focused forced air device causes vessel 62 to behave or function as a single pass counterflow integrated heat exchanger 110. In order to minimize energy consumption, fan 106 should be controllable, based on system heat rejection requirements. Although less effective, a ram air device, such as the use of only shroud 108, i.e., without a forced air device 106, may be utilized to provide forced convection. The use of purely natural convection, while being least expensive, is also least effective.

It should also be understood that other auxiliary devices such as level indicators, temperature and pressure transducers, and additional filters can easily be added to HRwiHE 62 or 110. Normally, a low pressure relief valve, vented to atmosphere, is also used to limit the maximum pressure within the vessel. Depending upon the fluid distribution between HRwiHE 62 and high pressure accumulator 54', the air pressure within vessel 62 will vary. The noted relief valve is preferably located at the top of vessel 62, above the maximum fluid level. It is desirous to have a positive pressure within vessel 62 in order to improve reliability and reduce the noise of the pump/motors.

It should be understood that while HRwiHE 62 and 110 have been described and discussed for use in cooling systems for hydraulic transmissions, their applicability is not limited thereto but can be used in to effectively cool working fluid without an additional heat exchanger in typical hydraulic circuits and lend themselves well for hydraulic systems that require large hydraulic tanks. The inner and outer shells are designed to channel the fluid to enhance the heat transfer capability, with the working fluid being drawn from the reservoir and returned to the reservoir through the integrated heat exchanger, in the manner noted.

It is deemed that one of ordinary skill in the art will readily recognize that the present invention fills remaining needs in this art and will be able to affect various changes, substitutions of equivalents and various other aspects of the invention as described herein. Thus, it is intended that the protection granted hereon be limited only by the scope of the appended claims and their equivalents.

What is claimed is:

1. A hydraulic reservoir with integrated heat exchanger comprising:

a. a generally cylindrical central section having an inner cylindrical shell portion and a peripherally-spaced cylindrical outer shell portion, with a first annular gap therebetween, said outer shell portion being provided with a plurality of external cooling fins;

b. a bottom cap portion, closing said central section at a lower end portion thereof;

c. a top cap portion, closing said central section at an upper end portion thereof, having an outer cap portion and a spaced inner cap portion, with a second gap therebetween forming a direct continuation of said central section first gap, said outer cap portion including a fluid inlet port in communication with said second gap;

d. said central section, together with said top and bottom cap portions, defining an internal central fluid cavity containing pressurized fluid; and e. a fluid supply/return port and at least one fluid outlet port extending into said central fluid cavity;

f. wherein incoming fluid, into said fluid inlet port, flows from said second gap into and through the entire length of said first gap before entering said central fluid cavity, thereby maximizing heat transfer from said fluid via said plurality of external cooling fins.

2. The hydraulic reservoir with integral heat exchanger of claim 1, wherein said plurality of external cooling fins is peripherally spaced and substantially radially arranged.

3. The hydraulic reservoir with integrated heat exchanger of claim 2, wherein each of said plurality of external cooling fins extends longitudinally for substantially the entire axial extent of said central section.

4. The hydraulic reservoir with integrated heat exchanger of claim 1, wherein said external cooling fins are integral with said cylindrical outer shell portion.

5. The hydraulic reservoir with integrated heat exchanger of claim 4, wherein said cylindrical outer shell portion is fabricated via one of extrusion and die casting.

6. The hydraulic reservoir with integrated heat exchanger of claim 4, wherein said cylindrical outer shell portion is constructed of a light metal.

7. The hydraulic reservoir with integrated heat exchanger of claim 6, wherein said light metal is an aluminum alloy material.

8. The hydraulic reservoir with integrated heat exchanger of claim 1, wherein said at least one fluid outlet port is located in said bottom cap portion.

9. The hydraulic reservoir with integrated heat exchanger of claim 1, wherein said fluid supply/return port is located in the lower end portion of said central section.

10. The hydraulic reservoir with integrated heat exchanger of claim 9, wherein said fluid supply/return port is situated so that said fluid flow is substantially tangentially directed relative to said central fluid cavity.

11. The hydraulic reservoir with integrated heat exchanger of claim 1, wherein said top and bottom cap portions are one of a hemi and semi-hemispherical shape.

12. The hydraulic reservoir with integrated heat exchanger of claim 1, wherein said hydraulic reservoir with integrated heat exchanger is mounted in a substantially vertical position, said substantially vertical configuration minimizing the possibility of fluid movement within said central fluid cavity, thereby minimizing cavitation of associated hydraulic pump/motor(s).

13. The hydraulic reservoir with integrated heat exchanger of claim 12, wherein said substantially vertical configuration also maximizes heat exchange effectiveness due to the long vertical distance said fluid travels while in contact with said cylindrical outer shell portion.

14. The hydraulic reservoir with integrated heat exchanger of claim 1, wherein said cylindrical inner and outer shell portions are connected via a plurality of intermediate spacers that also serve to maintain the uniformity of said first gap therebetween.

15. The hydraulic reservoir with integrated heat exchanger of claim 1, wherein said fluid inlet port also includes a fluid flow straightener that serves to peripherally, uniformly, channel incoming fluid flow into said second gap.

16. The hydraulic reservoir with integrated heat exchanger of claim 15, wherein said fluid straightener includes a central cone portion and a plurality of spaced, radial, riblets.

17. The hydraulic reservoir with integrated heat exchanger of claim 1, further including a peripheral, generally cylindrical shroud that surrounds said central section and said bottom cap portion, said shroud serving as a ram air device for said hydraulic reservoir with integrated heat exchanger, when air is in motion.

18. The hydraulic reservoir with integrated heat exchanger of claim 17, further including a forced air flow device, located at an end of said shroud, remote from said bottom end cap portion, said flow device providing forced convection, relative to said hydraulic reservoir with integrated heat exchanger and causing same to function as a single pass counterflow integrated heat exchanger.

19. In a hydraulic cooling circuit, a hydraulic reservoir with integrated heat exchanger, the latter comprising in combination:

a. a substantially cylindrical central section having an inner cylindrical shell portion and a peripherally-spaced outer cylindrical shell portion, with a first gap therebetween, said outer shell being provided with a plurality of radially-spaced, external cooling fins, said cooling fins being directed substantially along the entire length of said central section;

b. a curved bottom cap portion, closing said central section at a lower end portion thereof;

c. a curved top cap portion, closing said central section at an upper end portion thereof, having an outer cap portion and a spaced inner cap portion, with a second gap therebetween forming a direct continuation of said central section first gap;

d. said central section, together with said top and bottom cap portions, defining an internal central fluid cavity; and e. a fluid inlet port in said top cap portion, with a fluid supply/return port and at least one fluid outlet port extending into said central cavity;

f. wherein incoming fluid, into said fluid inlet port, flows from said second gap into and through said first gap before entering said central fluid cavity, thereby maximizing heat transfer, from said fluid therein, via said plurality of external cooling fins.

20. The hydraulic reservoir with integrated heat exchanger of claim 19, further including a peripheral, generally cylindrical, shroud that surrounds said central section and said bottom cap portion, said shroud serving as a ram air device for air in motion relative thereto.

21. The hydraulic reservoir with integrated heat exchanger of claim 20, further including a forced air flow device, located at an end of said shroud remote from said bottom cap portion, said flow device providing forced air convection relative to said hydraulic reservoir with integrated heat exchanger and causing same to function as a single pass counterflow integrated heat exchanger.

22. The hydraulic reservoir with integrated heat exchanger of claim 19, wherein said hydraulic reservoir with integrated heat exchanger is mounted in a substantially vertical position, said substantially vertical configuration minimizing the possibility of fluid movement within said central cavity, thereby minimizing cavitation in associated hydraulic components.

* * * * *